US011384945B2

(12) United States Patent
Aryeh

(10) Patent No.: US 11,384,945 B2
(45) Date of Patent: Jul. 12, 2022

(54) QUIET ROOM AIR CONDITIONING UNIT

(71) Applicant: Ahron M. Aryeh, Spring Valley, NY (US)

(72) Inventor: Ahron M. Aryeh, Spring Valley, NY (US)

( * ) Notice: Subject to any disclaimer, the term of this patent is extended or adjusted under 35 U.S.C. 154(b) by 159 days.

(21) Appl. No.: 16/929,520

(22) Filed: Jul. 15, 2020

(65) Prior Publication Data

US 2021/0381700 A1 Dec. 9, 2021

Related U.S. Application Data

(60) Provisional application No. 63/035,535, filed on Jun. 5, 2020.

(51) Int. Cl.

| | |
|---|---|
| ***F24F 1/031*** | (2019.01) |
| ***F24F 1/027*** | (2019.01) |
| ***F24F 11/88*** | (2018.01) |
| ***F24F 13/20*** | (2006.01) |
| ***F24F 13/22*** | (2006.01) |
| ***F24F 13/32*** | (2006.01) |

(52) U.S. Cl.

CPC ..... *F24F 1/031* (2019.02); *F24F 1/027* (2013.01); *F24F 11/88* (2018.01); *F24F 13/20* (2013.01); *F24F 13/224* (2013.01); *F24F 13/32* (2013.01); *F24F 2013/227* (2013.01)

(58) Field of Classification Search

CPC ..... F24F 1/031; F24F 13/32

See application file for complete search history.

(56) References Cited

U.S. PATENT DOCUMENTS

| | | | | | |
|---|---|---|---|---|---|
| 2,320,436 | A * | 6/1943 | Hull | F24F 1/60 | 62/262 |
| 2,737,788 | A * | 3/1956 | Buttner | F24F 1/0287 | 62/262 |
| 3,176,474 | A * | 4/1965 | Abbott | F24F 1/0003 | 62/262 |
| 3,438,219 | A * | 4/1969 | Brugler | F24F 1/029 | 62/448 |
| 3,448,590 | A * | 6/1969 | Eberhart | F24F 1/031 | 62/262 |
| 5,167,131 | A * | 12/1992 | Karkhanis | F24F 1/027 | 62/262 |
| 5,582,025 | A * | 12/1996 | Dubin | F24F 13/32 | 62/262 |
| 7,121,105 | B1 * | 10/2006 | Rais | F24F 1/027 | 62/262 |
| 10,203,130 | B2 * | 2/2019 | Gardikis, Sr. | F24F 1/027 | |
| 10,401,043 | B2 * | 9/2019 | Li | F24F 1/02 | |
| 10,739,018 | B2 * | 8/2020 | Baumann | F24F 13/32 | |

(Continued)

*Primary Examiner* — Christopher R Zerphey

(74) *Attorney, Agent, or Firm* — Joshua Kaplan, Esq; Kaplan Law Practice LLC

(57) ABSTRACT

Disclosed is the window unit of indoor air conditioning device. The disclosed device is split into two sections, with one being inside a room and the other hanging outside of the exterior wall. The two sections are connected together via a conduit channel, which is also used as a low-profile conduit, using flexible piping. The flexible piping are breakingly coupled within the conduit using snap connectors or twist-off connectors. The conduit being placed over a windowsill, wherein the windowsill supporting the weight of both containers.

20 Claims, 11 Drawing Sheets

(56) References Cited

U.S. PATENT DOCUMENTS

| | | | | |
|---|---|---|---|---|
| 2014/0020421 | A1* | 1/2014 | Gallo | B23P 11/00 62/263 |
| 2017/0284683 | A1* | 10/2017 | Gallo | F24F 13/0245 |
| 2021/0190330 | A1* | 6/2021 | Martinez Galvan | F24F 1/029 |

* cited by examiner

QUIET ROOM AIR CONDITIONING UNIT

CLAIM OF PRIORITY

This application claims priority to the US Provisional Utility Patent Application No. 63/035,535, which was filed on $5^{th}$ of Jun. 2020, the contents of which are incorporated herein by reference.

FIELD OF THE INVENTION

The present invention relates to window cooling and heating units, namely a stand-alone room air conditioning unit having the noisiest component installed behind a wall.

BACKGROUND OF THE INVENTION

Modern air conditioning technology has been invented at the turn of the twentieth century. A room air conditioning unit was not invented until 1930s. The residential sector did not adopt a room temperature control unit on a massive scale until the 1950s. Since then, the configuration a representative unit has been virtually unchanged, with slight improvements introduced periodically to increase performance or to improve efficiency.

Like all air conditioning units, a room unit requires two coil systems, at least one fan and a compressor. The noisiest element of the unit is the compressor, followed by the fan. One solution to solving the noise problem calls for an internal condenser coil and fan to be housed in a separate unit mounted on the inside of a room, while another unit containing evaporator coils, fan and compressor is placed somewhere outside, and usually mounted on especially installed brackets along the exterior wall of a building. The two units are connected using rigid piping for liquid/gas exchange, and they often share circuitry. While this solution clearly resolves the noise issue, it also increases the cost of the unit, as well as installation, operating costs of and environmental costs of a room unit. Furthermore, such installation necessitates involvement of a professional HVAC technician and a building contractor.

Most room units are window units. A window provides a ready opening for the evaporator coil, without the need of making holes in a wall. However, doing so compromises the use of the window as a source of light and fresh air and obstructs the windowsill that is now covered by the air conditioning unit. Furthermore, since a window unit is largely held back from falling out by the window in which it is mounted, to avoid an instance of a falling air conditioning system down many floors to the street below, such units cannot be installed in a building having more than a couple of floors unless a special wall port is provided.

Furthermore, a window unit, whether it is installed in a window or into an opening in a wall made for this purpose, is either attached to the window pane, or mounted on special brackets pinned into the exterior wall below the window or opening. Such installation usually leaves the window with permanent damage. Since a window unit must necessarily be narrower than the window itself, the empty void is covered using ugly accordion expanders or other makeshift materials and some tape.

The aforementioned problems have not gone unnoticed, and prior does provide some examples of units that attempt to resolve some of the issues identified above.

BRIEF DESCRIPTION OF THE RELATED ART

One such example is for U.S. Pat. No. 2,737,788 to Buttner. In this example the main portion of the unit is hung outside the window. However, the width of the gap straddling the windowsill is not adjustable, and the windowsill is still sacrificed.

Another example is U.S. Pat. No. 3,439,219 to Brugler. In this example, the unit contains a gap to accommodate the opening and closing of the windowpane. Closing the windowpane should block out some of the noise, however, a window is not as thick as a wall. Therefore, far more noise will leak back into the room than if the wall is providing the blocking. Furthermore, the window is still obstructed, and the windowsill is still sacrificed. Another key difference is that the gap in Brugler is not adjustable. Finally, this unit is severely imbalanced, with the heavier end being outside of the room. This requires a deployment of a separate frame or professional installation to secure the device.

Yet another example is the US. Pat. App. 2017/0284683 to Gallo. This reference provides for a means to adjust the gap and the gap is used for straddling a support surface such that a wall stands in between the room and the noise. However, unlike the disclosed invention, the two halves in Gallo are structurally coexistent and cannot exist independently. Therefore, in an even when a component in one of the sections breaks, one may need to replace the entire unit. On the contrary, in the disclosed device, if the particular component cannot be changed by itself, only the container where such component is installed needs to be replaced.

Various implements are known in the art but fail to address all of the problems solved by the invention described herein.

SUMMARY OF THE INVENTION

The disclosed apparatus is a room unit which may function as an air conditioning unit, or as an air cooling and heating unit, depending on which internal components are installed. The internal components are separated into two containers that are independent from each other. Each container is attached to an overhead frame. The attachment and the strength of the frame is designed to securely hold the containers suspended over a support surface.

The gap is used to mount the unit over a support surface, such as a window frame or a wall. Each frame slides in correspondence to each other. Therefore, the width of the gap between the containers is fully adjustable. The frame supporting each container extends to one side beyond the perimeter of the container, and this extension is covered by a plate. Such plates of first and second containers overlap each other and function as a strengthening element for the frame, as a way to seal the frame from below and as a conduit.

The components of the two containers are linked together using flexible piping, which is deliberately made with additional length to accommodate a lengthening of the conduit. The two frames are completely separable by having the flexible piping connect together inside the conduit using hermetic snap connectors.

Finally, the top of each frame is covered by a flat cover. The flat cover is designed to give the disclosed device a uniform profile, such that the utility of a windowsill functioning as a shelf, which becomes obstructed by the deployment of the unit, is restored.

When the unit is deployed thought a wall, an opening need only be big enough to accommodate the width and height of the conduit.

DESCRIPTION OF THE PREFERRED EMBODIMENTS

Figure 1:
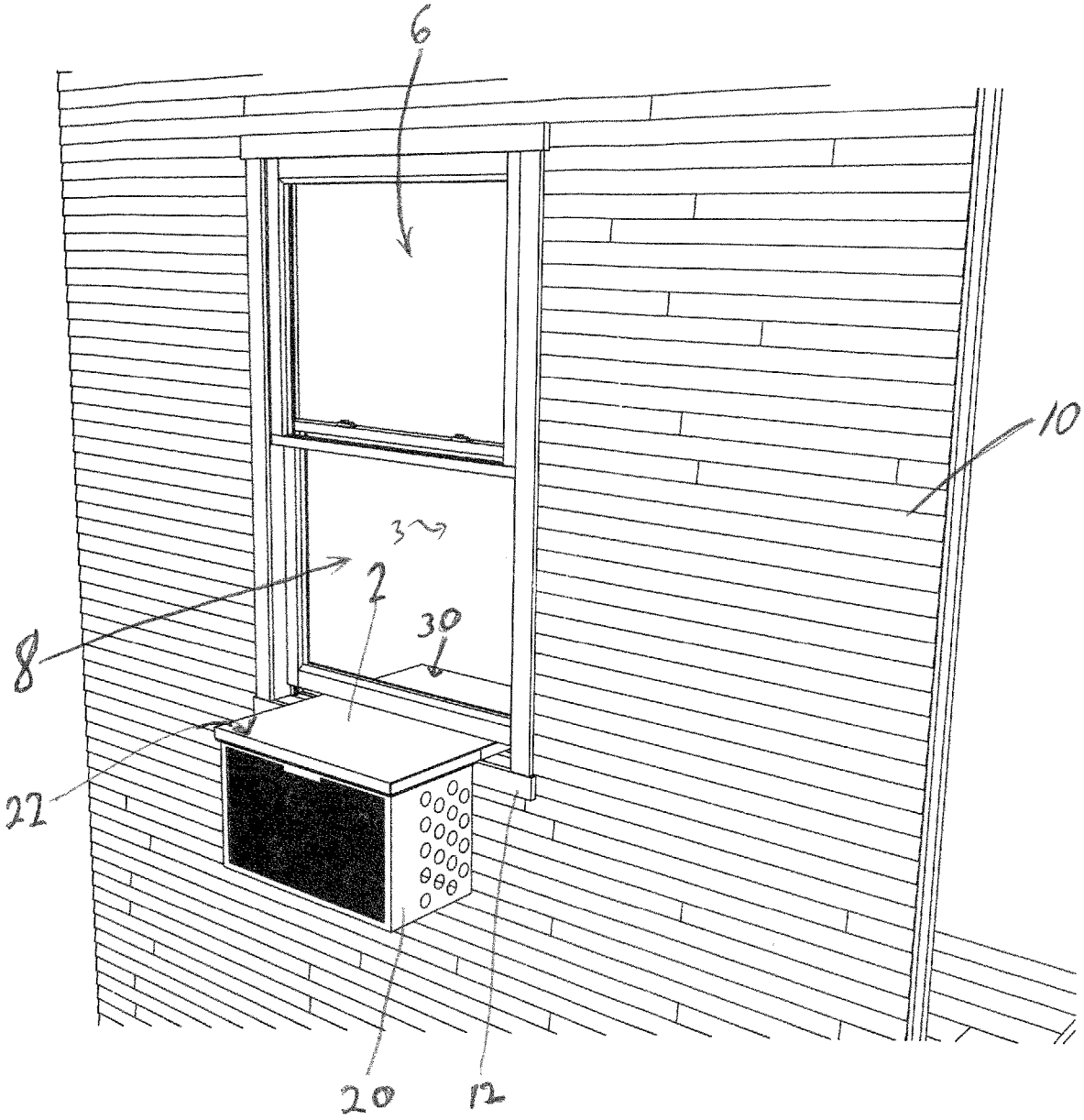
FIGS. 1 & 2 show the disclosed invention installed in a residential environment.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 demonstrates the disclosed air conditioning (AC) unit 2 deployed inside a window 3. Like in most window units, a double (as shown) or triple hung casement window is the preferred window installation. The lower pane 8 is lifted slightly to allow the passage of the conduit 22. The exterior unit 20 and the interior unit 30 are both suspended from the conduit frame 22. The windowsill portion of the window frame 12, carries the entire weight of the exterior and interior units 20 and 30, respectively. It should be noted that upon installation of the displayed unit, that the lower pane 8 is lowered to within approximately five centimeters of the lower member of the frame 5, to allow for the thickness of the conduit frame 22. Once the unit 2 is in place, both windowpanes 6 and 8 may be operated as before. As appreciated through observation of parts shown in FIG. 1, no portion of the windowpanes 6 and 8 are obstructed in any way. A refrigerant charging manifold 93 may be used to monitor, discharge and recharge the level of refrigerant coursing through the plurality of tubing 72 and 90.

Figure 2:
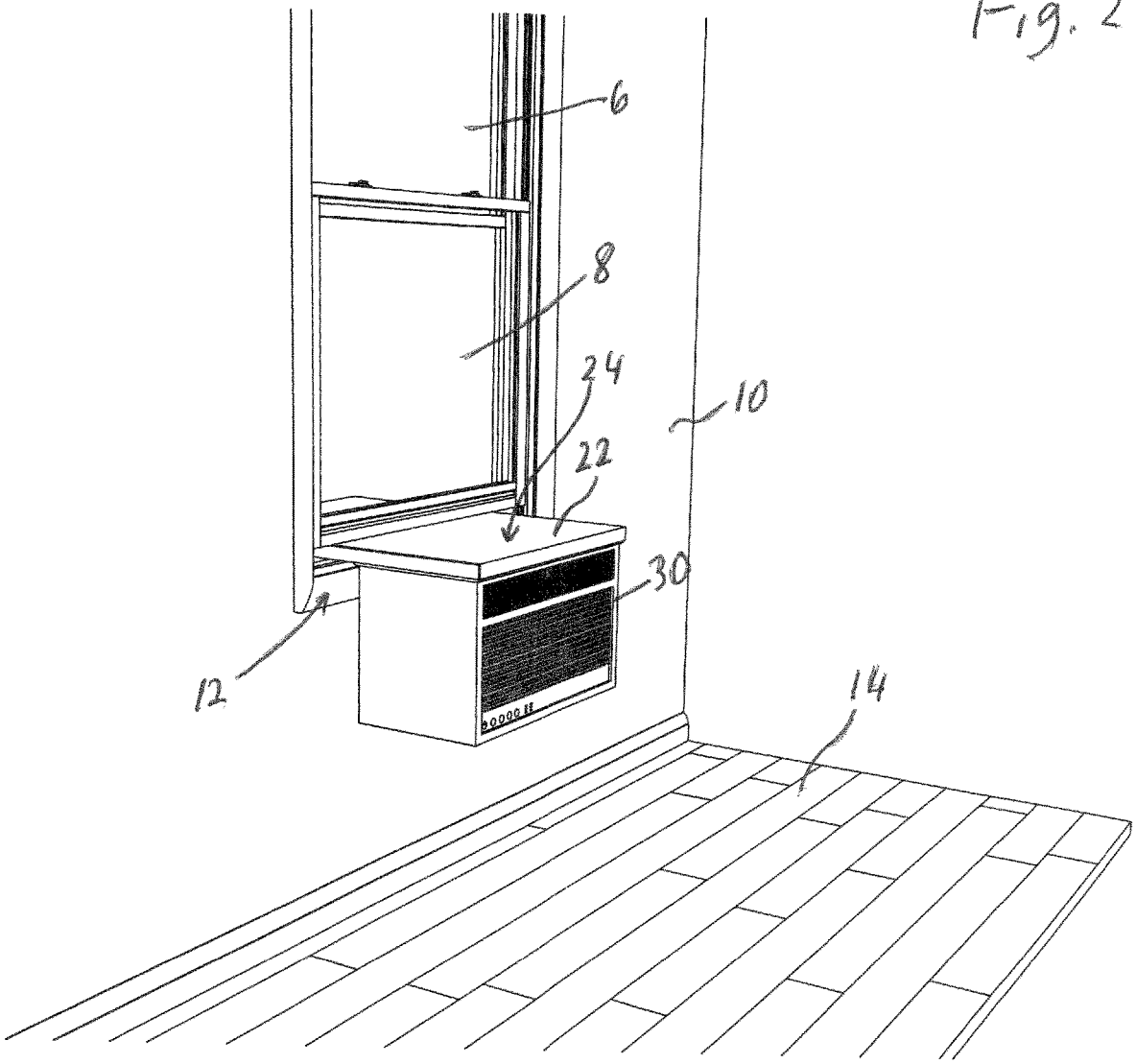

FIG. 2 provides a demonstration of the interior view of the wall 10 within an interior space 14. The interior unit 30 of the disclosed device 2 is suspended from the conduit frame 22. The conduit frame 22 lays directly over the lower window frame member 16, which may also form a windowsill. The surface formed by the first wall 24 replaces the windowsill 16 that is now blocked by the conduit fame 22. Indeed, the first wall 24 enhances the function of the windowsill it replaces by providing a larger and more evenly distributed surface area.

Figure 3:
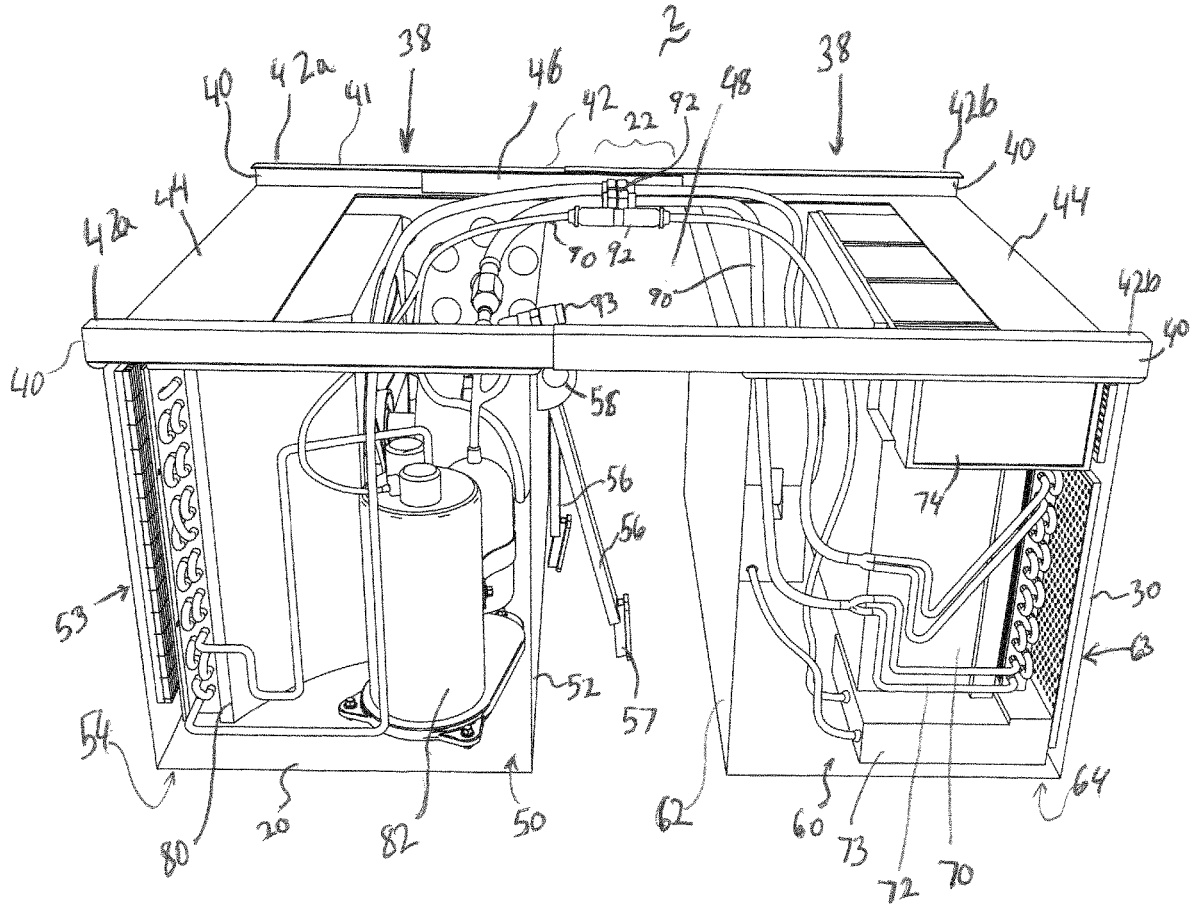
FIG. 3 is a cutaway sideview of the disclosed invention.

The sideview of the disclosed air conditioning unit 2 is shown in FIG. 3. The conduit frame 22 is comprised of two half frames 38. Each half-frame having an upright rail 42 forming a lateral member on either side of the crossmember 44. The upright rail 42 is formed from an upright wall 40 and second wall 41 extending at an angle, preferably a right able, from the free end of the upright wall 40, in the direction overhanging the crossmember 44.

The upright rails 42*a* and the upright rails 42*b* that together form the two halves of the two half frames 38, are in slidable association with each other, meaning that they can be extended to increase the gap between the first container 50 and the second container 60, or shortened to reduce the gap between the first container 50 and the second container 60. A tubal brace 46 may be added to each rail 42. The tubal brace being on either side of the middle cross member 48, which covers the gap between the first container 50 and the second container 60. It is appreciated that rails 42*a* and 42*b* are fully telescopic with respect to each other.

The first container 50 is made of four walls 52, that form a perimeter around the bottom wall 54. The exterior wall 53 contains a gap to permit exterior facing fins. The first container 50 is permanently attached beneath the half frame 38 of the exterior unit 20. The second container 60 is made of four walls 62 that form a perimeter around the bottom wall 64. The interior facing wall 63 contains a gap for the air exchange grille. The second container 60 is permanently attached to the underside of the half frame 38 of the interior unit 30.

It is preferred that the wall 52 that is facing the gap between the first container 50 and the second container 60 includes at least one stability arm 56 that is axially coupled to a pivot 58. The stability arm 56 containing a swiveling and adjustable foot 57. As will be shown in later figures, the purpose of the stability arm 56 is to achieve a substantially immobile balance when the leg 56 is jammed against an outer wall of a structure.

The internal components that are visible is an evaporating coil 70 a plurality of refrigerant tubes 72, a blower compartment 74, a control board 73. The control board is a switch that controls the internal air conditioning components of the disclosed device housed in the external and internal units 20 and 30, respectively. The components of the external unit 20 are connected to the switch via wiring that passes over the middle crossmember component 48 through flexible tubing 90. In the external unit, visible is the compressor 82 and condenser coil and blower 80. The tubes 90 spanning the middle cross member 48 are preferably made of flexible materials and linked together using snap, twist or bayonet type connectors 92. It should be appreciated, that when the snap connectors contain an internal valve that is close when the connector is not attached to a corresponding connector. As such the outer unit 20 and the inner unit 30 may be pulled apart from each other and reconnected again during mountings, dismounting and servicing of the disclosed unit 2.

Figure 4:
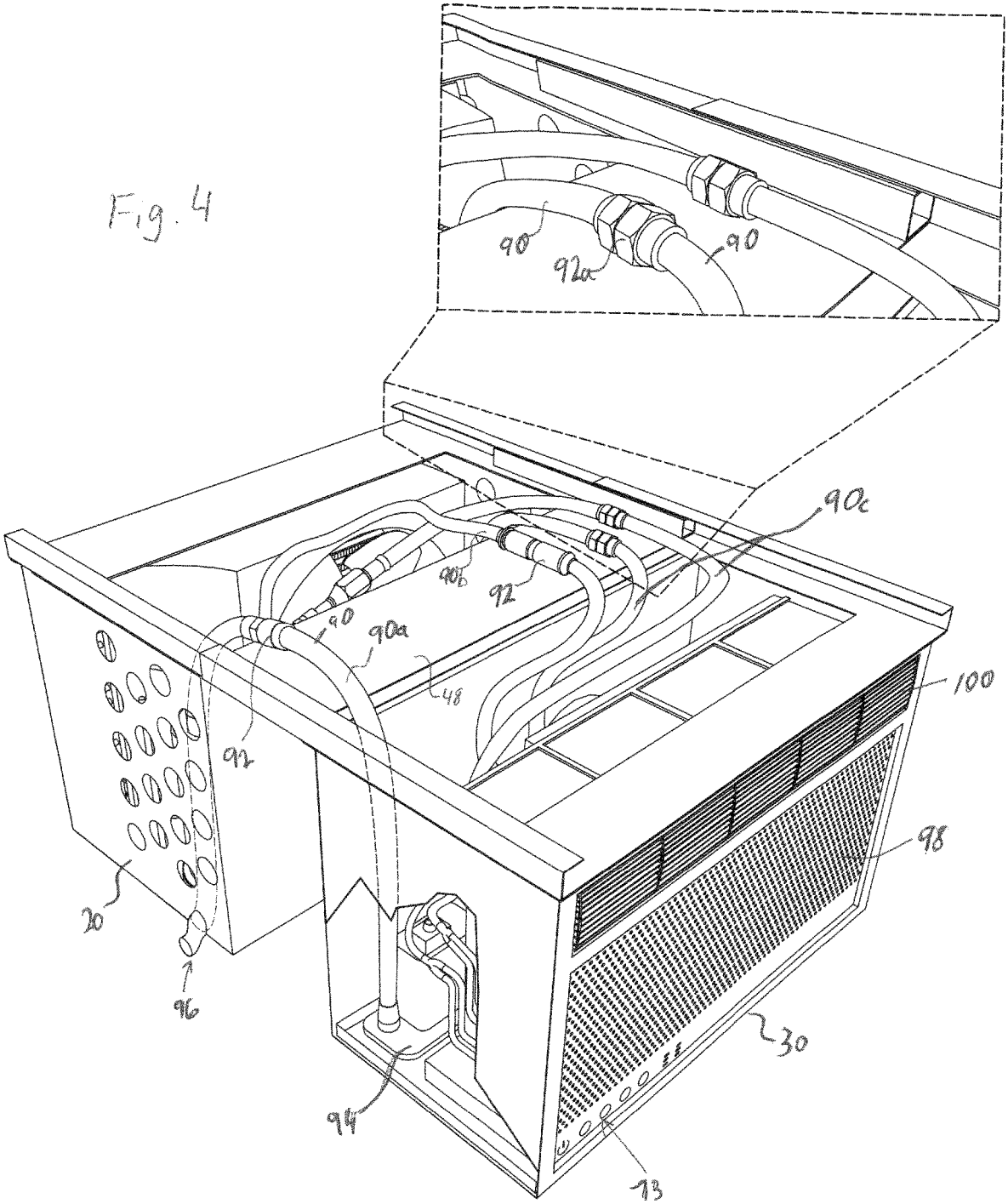
FIG. 4 is a closeup diagram of flexible tubing with decoupling connectors.

The perspective view shown in FIG. 4 is an up-close diagram of flexible tubing 90. The flexible tubing is required to link the air conditioning components in the external unit 20 to the air conditioning components in the internal unit 30. The tubing 90 may be comprised of evaporation pump hose 90*a*, a wiring conduit 90*b* and refrigerant tubing 90*c*. The tubing is connected at the middle cross member 48 with snap connectors 92 or twist-off connectors 92*a*. the evaporation pump hose 90*a* carries condensation collected in the evaporator pan 94 over the middle cross member 48 and into the external unit 28, where it will be channeled to the outside via the spout 96. In a purely self-contained embodiment, the spout 96 would be replaced with an evaporator coil, that would turn the liquid into vapor so as not to produce a stream of water dripping from the exterior unit 20. Appreciably, this feature would be especially desirable on street side and high-rise installations. Since FIG. 4 is a perspective view, also visible in this diagram is a control panel 73, an air intake grill 98 and blow vents 100.

Figure 5:
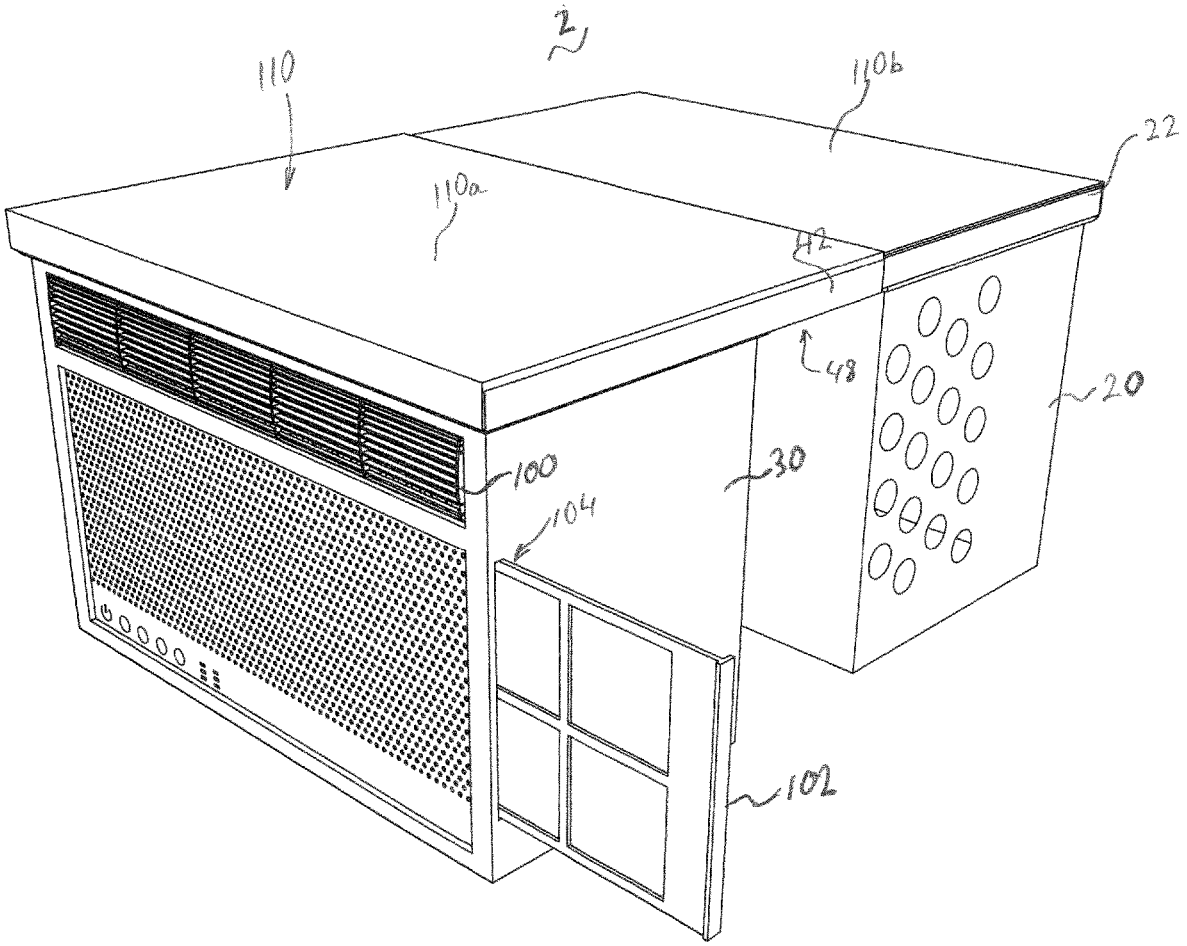
FIG. 5 is a fully assembled device demonstrating intake filtration and top cover.

A fully assembled unit is shown in FIG. 5. An intake filter 102 is inserted through a slot 104 in the sidewall. The conduit frame 22 is showing a cover 110. The cover 110 is split into two overlapping components 110*a* and 110*b* that slide beneath each other so that the external and internal units 20 and 30, respectively, may be moved apart or moved closer together without removing the cover 110. It is appreciated that with the cover 110 being in place, the middle cross member 48 and the upright rails 42 form a conduit of approximately 3.8 centimeters tall, encompassing the entire width of the unit 2.

Figure 6:
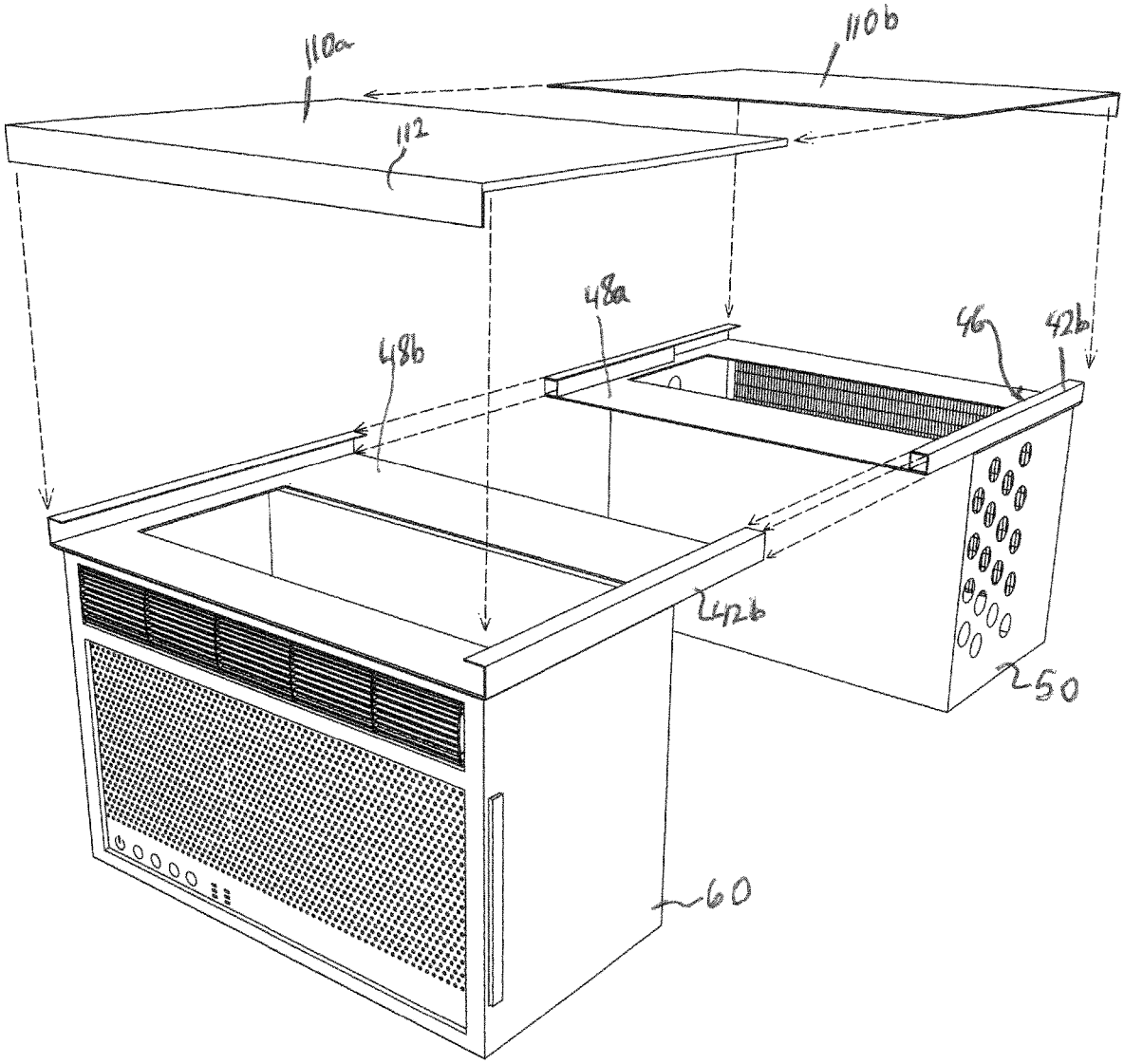
FIGS. 6 & 7 are exploded diagrams of the components making up the disclosed device.
Figure 7:
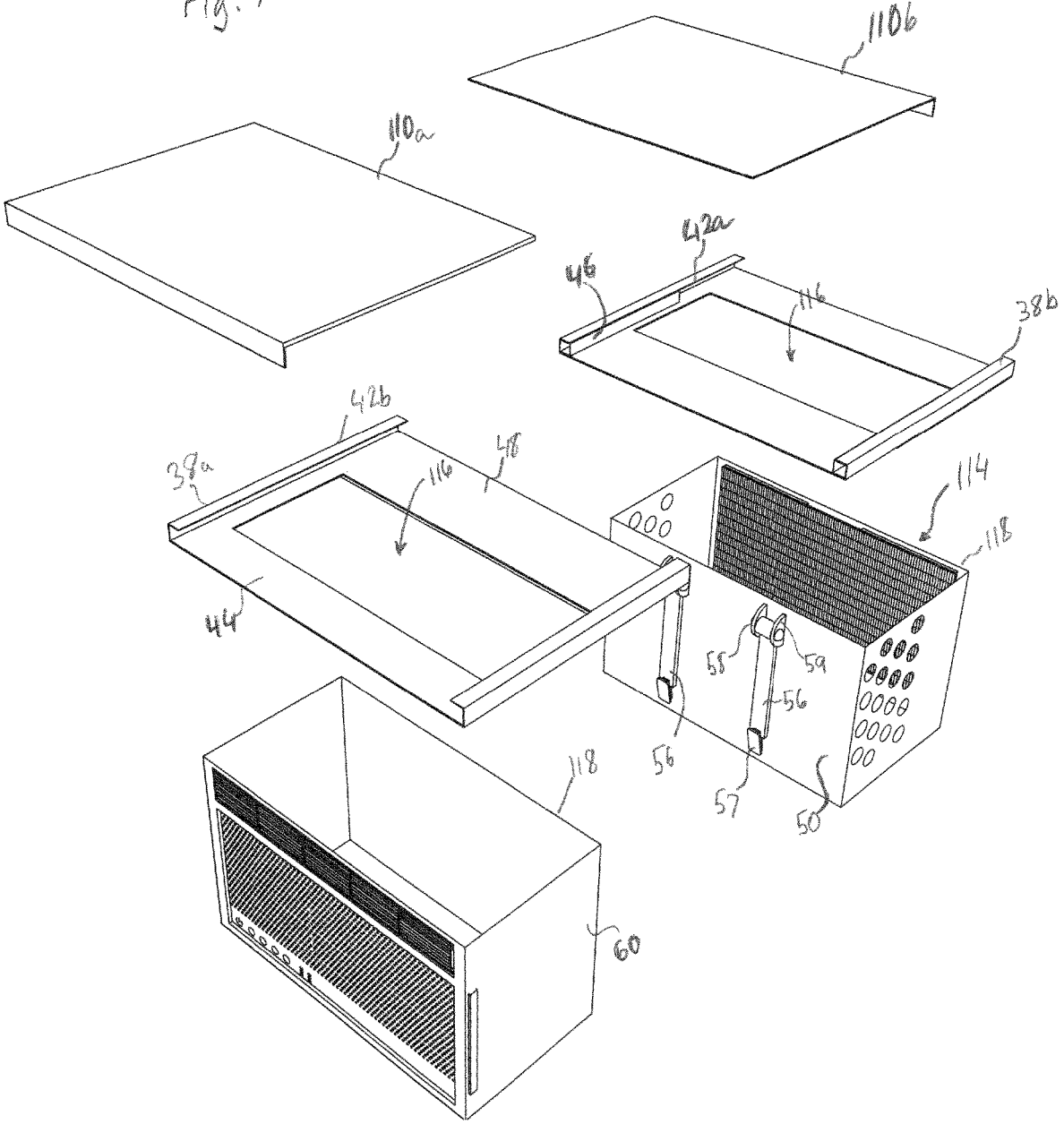

The conduit frame 22 may be assembled utilizing any number of components in a plurality of different configurations. Demonstrated in FIGS. 6 and 7 is the preferred embodiment showing a first container 50 and a second container 60. A frame 22 is made of two half frames 38*a* and 38*b* that telescope in respect to each other. Each half frame is composed of parallel upright rails 42*a* or 42*b*, a cross member 44 and a middle cross member 48. It is noted that the middle cross member 48, like everything in the middle section between the first and second containers 50 and 60, is made of two halves, to enable for slidable association between members. The middle cross member 48 is therefore made of two halves 48*a* and 48*b*. The brace 46 is shown to be part of the half frame 38*b*. However, the brace 46 may be placed on either of the half frames.

The half frames 38*a* and 38*b* are riveted, welded, or attached with fasteners to the top end 118 of the container. Once attached, the gap 116 may be used to access internal components of the air conditioning unit 2 for service and repair. The entire frame is then covered with a lid 110, formed from two half covers 110*a* and 110*b*. The front of the lid 110 features a lip 112. The lip 112 may exist on three sides of the lid 110, except for the side that is facing the opposite half frame.

Demonstrated further in FIG. 7 are stability arms 56, that are pivotably connected through a pivot 58 a hinge 59. The stability members 56 may instead be protrusions or legs facing the exterior surface of a wall. The stability arms 56 are a precautionary measure and the unit itself is already substantially balanced without their use.

Figure 8:
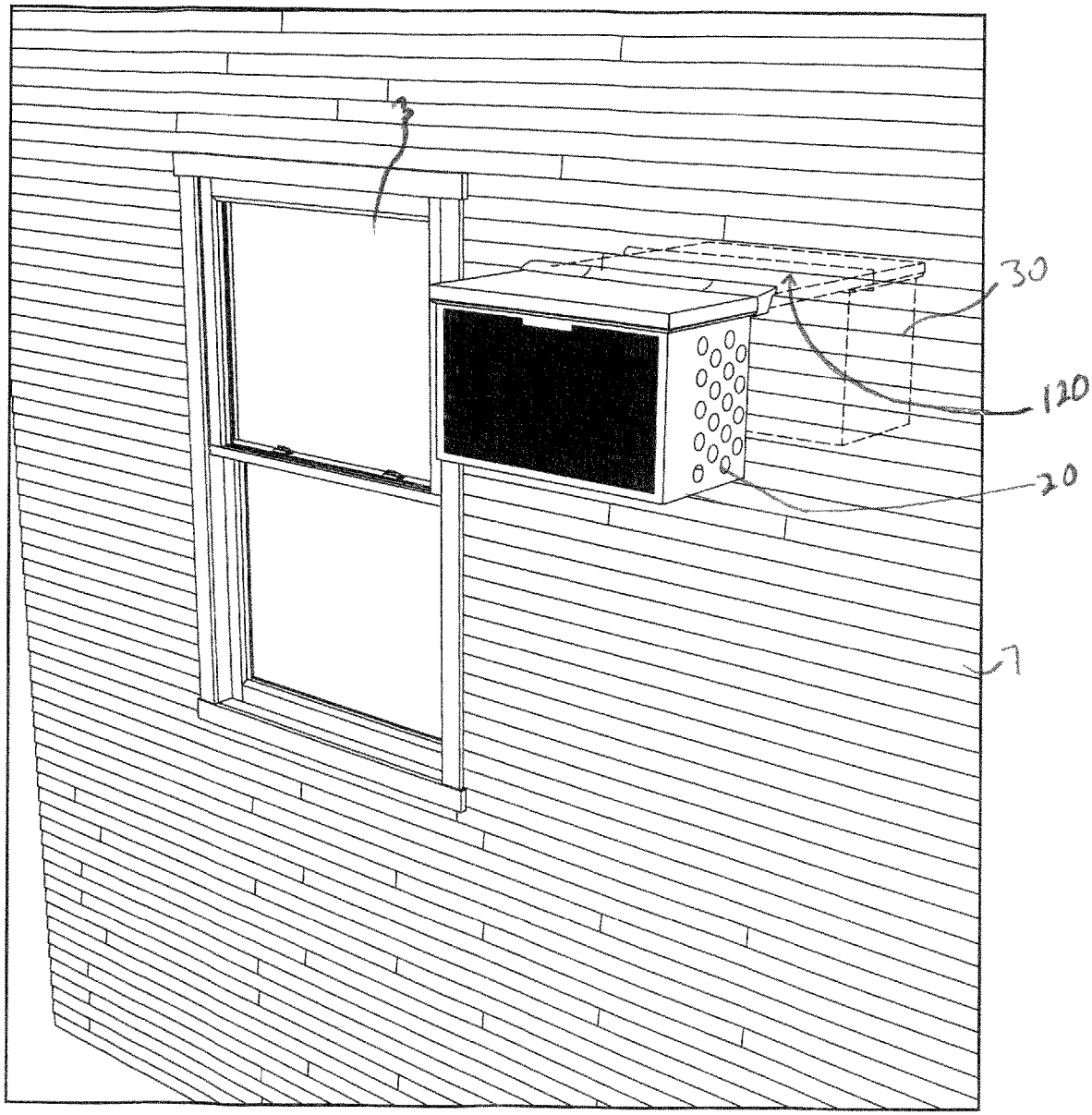
FIG. 8 is a device, shown deployed through a slot in a wall rather than a window.

The disclosed air conditioning device 2 can be easily installed through a slot in the wall as shown in FIG. 8. The slot 120 through the wall 7 may be just slightly wider and taller than the conduit frame 22. Alternatively, since the disclosed embodiment utilizes flexible tubing 90 (FIG. 4) these can be threaded through using individual openings and no slot is then required through the wall 7.

Figure 9:
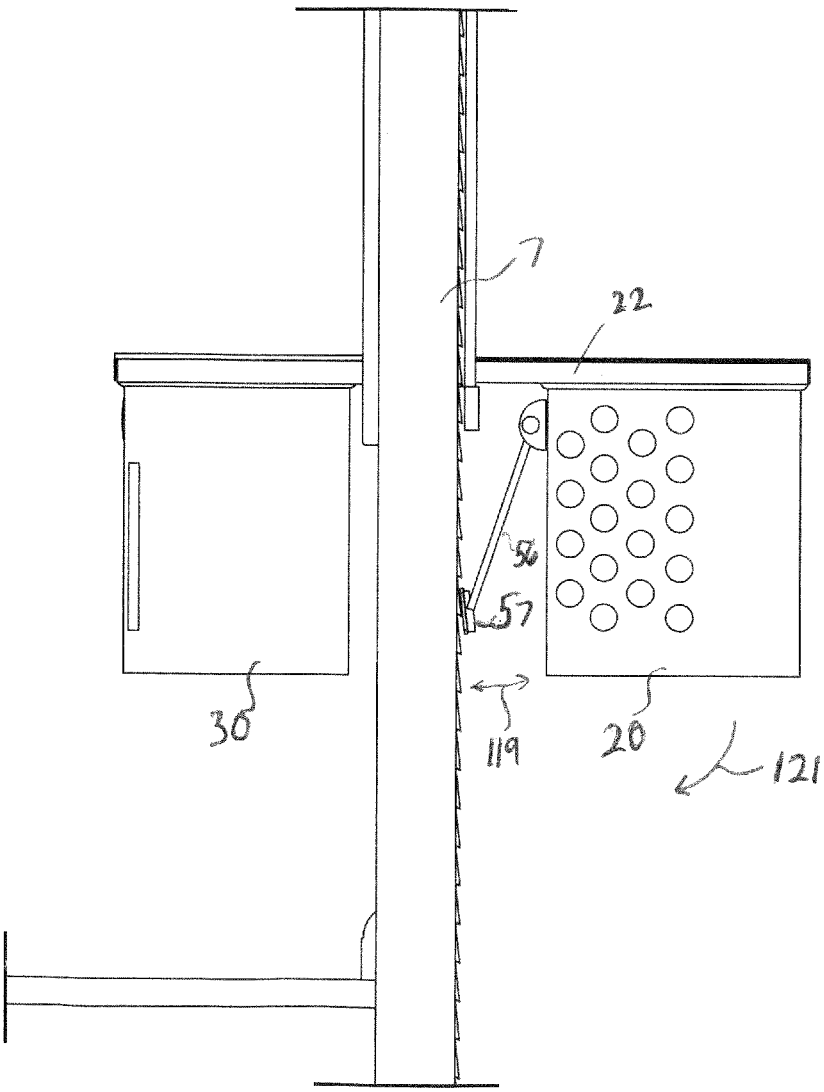
FIG. 9 demonstrates a side view of the disclosed device, with stability levers deployed.

The use of balancing arms 56 is further demonstrated in a sideways sectional FIG. 9. The unit is balanced over the windowsill and may be done by moving the unit in a lateral direction 119, until a balance is achieved. Alternatively, one can extend the external unit 20 a little further from the wall 7 and then direct the external unit 20 to be biased to swing in the direction 121, which is the force used to jamb the adjustable feet 57 of the balancing arms 56 against the wall 7. Alternatively, a substantially straight protrusions facing the exterior of the wall 7 and placed substantially toward the bottom of the structure facing wall of the exterior unit 20, would achieve the same gravity driven stability. The actual dimensions of the external and internal units 20 and 30, which are clearly visible here may vary depending on the size and capacity of internal components.

Figure 10:
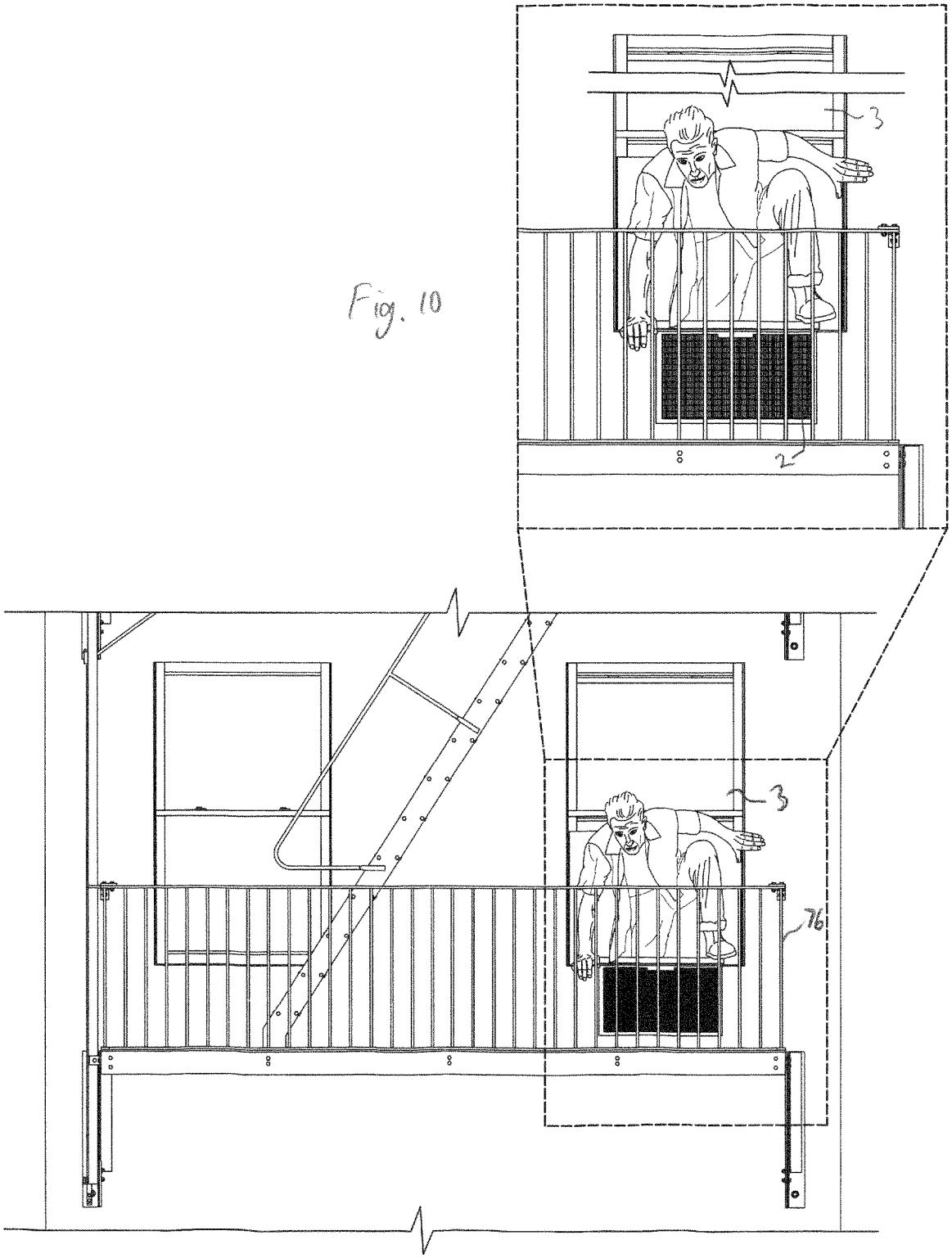
FIG. 10 is a demonstration of a resident able to utilize a fire escape despite the presence of an installed air conditioning window unit.
Figure 11:
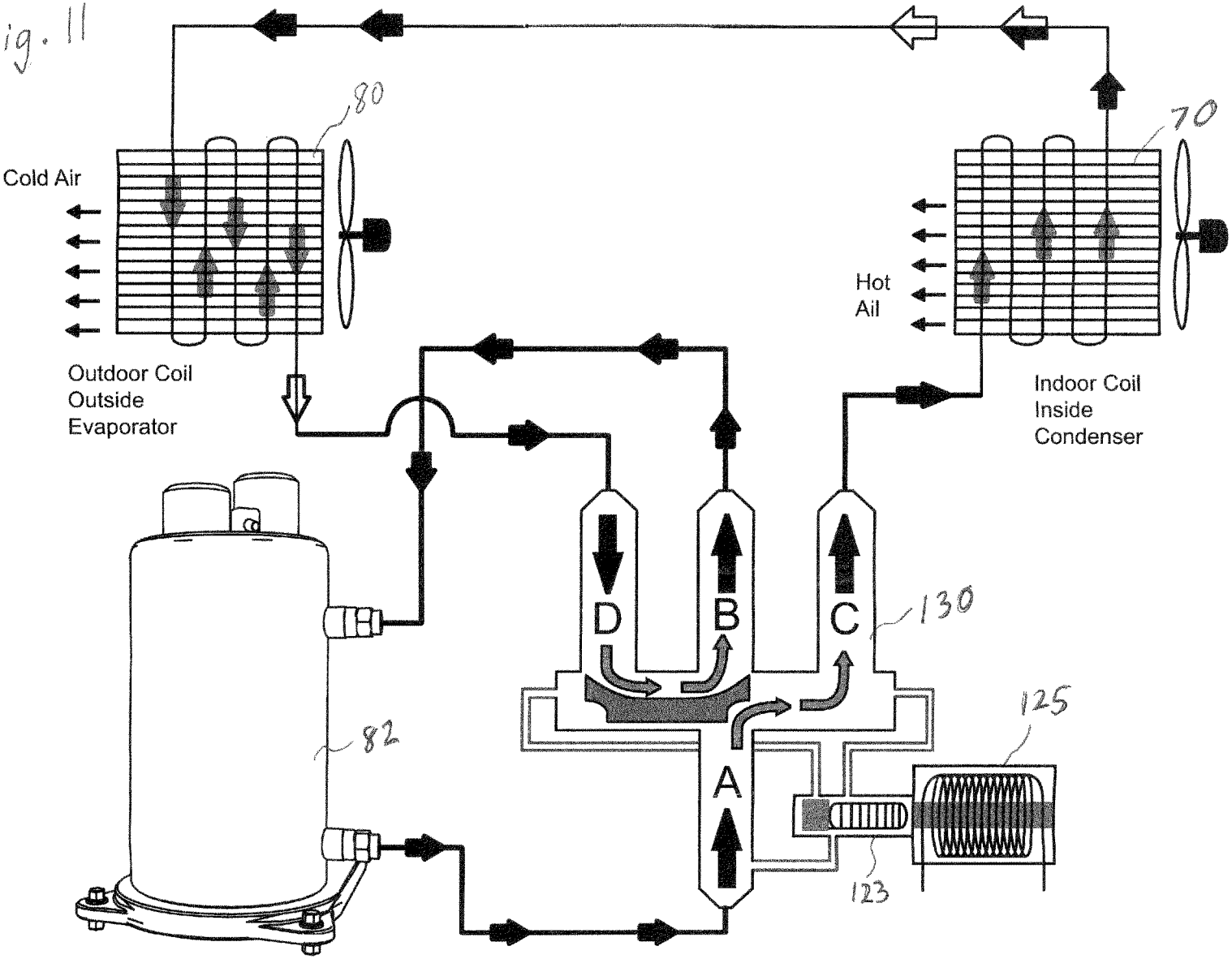
FIG. 11 is a demonstration of a hot/cold window unit (heat pump) embodiment, showing a safety shutoff switch.

The disclosed unit 2 may be used in a fire escape setting, or in any setting where the usage of a window 3 needs to remain almost completely unobstructed and undeterred by the presence of the installed window air conditioning unit. FIG. 10 demonstrates a subject climbing out of the window 3 and over the disclosed unit 2. The majority of the window aperture is still usable as a point of access and egress despite the presence of the unit in the window 5.

Finally, it should be appreciated that the air conditioning unit shown 2 is not limited to usage to cool the internal atmosphere, but also as a means to warm it. To do so, one of the containers 50 or 60 must retain a three-way valve 130 which allows for the reversal of the flow of refrigerant in a way that the roles of inner and out coils reverse. To avoid damaging the external coils 80, the disclosed device will preferably be equipped with a temperature sensor 125, which when connected to a solenoid 123, which forms a second switch of the unit, and which will disable the warming function of the unit if the outside temperature becomes too cold for safe or practical operation of the evaporator coil 80.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A room air conditioning unit comprising; a first section and a second section; said first section comprised of a first container with four walls forming a perimeter around a bottom wall; a first frame said first frame having two parallel upright rails, said two parallel upright rails linked together by at least one crossmember; said first container attached to the underside of said first frame; wherein free ends of said upright rails terminate at some distance beyond said first container; a one half of a middle cross member mounted to the underside of the parallel upright rails, wherein the middle cross member covering the gap between said parallel upright rails; wherein the middle cross member being adjacent to the first container, said middle cross member covering the space between said first container and the free ends of said parallel upright rails;

said second section comprised of a second container with four walls forming a perimeter around a bottom wall; a second frame, said second frame having two parallel upright rails, said two parallel upright rails linked together by at least one crossmember; said second section attached to the underside of said second frame; wherein free ends of said parallel upright rails of the second frame terminating at some distance beyond said second container; a second half opposite to said one half of said middle cross member spanning the two parallel upright rails of the second frame, said second half attached adjacently to said second container, said second half of the middle crossmember covering the space between said second container and the free ends of said parallel upright rails of said second frame;

wherein said free ends of said parallel rails of said first frame are in a slidable association with said second frame;

a first cover, said first cover having a lip and a top surface, said first cover removably covering said first frame;

a second cover, said second cover having a lip and a top surface, said second cover removably covering said second frame;

wherein said first cover and said second cover in a slidable association within each other, and said first plate and said second plate in a slidable association with each other when said parallel upright rails of said first container and said parallel upright rails of said second container are in a slidable association with each other;

a gap existing between said first container and said second container, said gap spanned by free ends of said parallel upright rods of said first frame and said second frame when said free ends are in a slidable association;

wherein said first half of said middle crossmember and said second half of said middle cross member, flanked by upright rails forming a conduit for a passage of flexible pipes between components held within said containers;

and wherein said gap being used to mount said room air conditioning unit over a support surface.

2. The room air conditioning unit of claim 1, wherein the width of said gap may be adjusted by pulling said first frame and said second frame further apart or closer together.

3. The room air conditioning unit of claim 1, wherein said first container further comprising a compressor, a coil, and a fan; said second container further comprising a coil, a fan, a control panel, a thermostat and a switch; wherein an inlet pipe and an outlet pipe of said coil of said first container and said coil of said second container connecting to said compressor using flexible pipes; wherein components comprising said coil, said compressor and said fan of the first container and said coil, said fan, said control panel and said thermostat of said second container being controlled by said switch; wherein wiring for said components enclosed in a flexible conduit.

4. The room air conditioning unit of claim 3, unit further comprising a second thermostat, said second thermostat installed within said first container; and wherein said thermostat connecting to a second switch, said second switch controlling said compressor and capable of overriding said switch in said first container.

5. The room air conditioning unit of claim 2, further comprising a drainage pan; said drainage pan collecting condensation runoff from said coil within said second container; a drainage pump, said drainage pump removing condensation from said drainage pan; wherein said drainage pump channeling said condensation through a flexible pipe into an outlet opening in said first container; and wherein said flexible pipe passing through said conduit.

6. The room air conditioning unit of claim 3, further comprising a drainage pan; said drainage pan collecting condensation runoff from said coil within said second container; a drainage pump, said drainage pump removing condensation from said drainage pan; wherein said drainage pump channeling said condensation through a flexible pipe into an outlet opening in said first container; and wherein said flexible pipe passing through said conduit.

7. The room air conditioning unit of claim 4, wherein slidable association between free ends of said parallel upright rails of said first frame and said free ends of said parallel upright rails of said second frame may be locked in place using a press screw or a drop pin.

8. The room air conditioning unit of claim 2, wherein said support surface is a window frame.

9. The room air conditioning of claim 2, wherein said support surface is a wall, wherein the width of an opening of said wall is slightly wider than slidable association of said parallel rods of said first and second frame; and wherein the height of said opening is between one and three inches.

10. The room air conditioning unit of claim 2, wherein a wall of said first container further comprising at least one arm, a proximal point of said arm pivotally connected to one of said walls of said first container that is adjacent and parallel to a support surface; and wherein when said air conditioning unit is placed over said supporting surface, said at least one arm pivoting toward said supporting surface, such that a distal end of said at least one arm securely jamming against said supporting surface.

11. The room air conditioning unit of claim 3, wherein said coil further comprising a manifold port in said first container and said second container.

12. The room air conditioning unit of claim 3, wherein said flexible conduit or said flexible piping are made of separate section, with one of said separate section being installed inside said first container and with another of said separate sections being installed in said second container, wherein said separate sections of said flexible tubing disconnectingly connecting using snap connectors; and wherein said separate sections of said flexible conduit disconnectingly connecting using snap connectors.

13. A room air conditioning unit comprising; a first section and a second section; said first section comprised of a first container with four walls and a bottom wall; a first frame said first frame having two parallel upright rails, said two parallel upright rails linked together by at least one cross rod; said first section attached to the underside of said first frame; wherein free ends of said parallel upright rails terminate at some distance beyond said first container; a first plate attached to said parallel upright rails adjacent to said first section, said first plate covering the space between said first container and distal ends of said parallel rails;

said second section comprised of a second container with four walls and a bottom wall; a second frame, said second frame having two parallel side rods, said two parallel side rods linked together by at least one cross rod; said second section attached to the underside of said second frame; wherein free ends of said parallel upright rails of said second frame terminate at some distance beyond said second container; a second plate attached to both parallel upright rails of said second frame, said second plate attached adjacently to said second section, said second plate covering the space between said second container and distal ends of said parallel rails of said second frame;

wherein said free ends of said parallel upright rails of said first frame and said second frame are in a slidable association;

said first container further comprising a compressor, a coil, and a fan;

said second container further comprising a coil, a fan, a control panel, and a thermostat and a switch;

wherein an inlet pipe and an outlet pipe of said coil of said first container and said coil of said second container connecting to said compressor with flexible pipes;

wherein components comprising said coil, said compressor and said fan of the first container and said coil, said fan, said control panel and said thermostat of said second container being controlled by said switch; wherein wiring for said components enclosed in a flexible conduit;

a first cover, said first cover having a lip and a top surface, said first cover removably covering said first frame;

a second cover, said second cover having a lip and a top surface, said second cover removably covering said second frame;

wherein said first cover and said second cover in a slidable association within each other, and said first plate and said second plate in a slidable association with each other when said parallel rails of said first container and said parallel rails of said second container are in a slidable association with each other;

wherein a gap existing between said first container and said second container, said gap spanned by distal ends of said parallel rails of said first frame and said second frame;

wherein said first plate and said second plates forming a conduit for said flexible tubes and said flexible conduit;

a snap connector, said snap connector disposed on each said flexible tubes and said flexible conduit, wherein said flexible tubes and said flexible conduit may be coupled and decoupled within said conduit;

and wherein said gap being used to install said room air conditioning unit over a support surface.

14. The room air conditioning unit of claim 13, wherein the width of said gap may be adjusted by pulling said first frame and said second frame further apart or closer together.

15. The room air conditioning unit of claim 13, further comprising a manifold port for recharging, monitoring or draining a quantity of refrigerant.

16. The room air conditioning unit of claim 14, further comprising a drainage pan; said drainage pan collecting condensation runoff from said coil within said second container; a drainage pump, said drainage pump removing condensation from said drainage pan; wherein said drainage pump channeling said condensation through a flexible pipe into an outlet opening in said first container; and wherein said flexible pipe passing through said conduit.

17. The room air conditioning unit of claim 13, further comprising a drainage pan; said drainage pan collecting condensation runoff from said coil within said second container; a drainage pump, said drainage pump removing condensation from said drainage pan; wherein said drainage pump channeling said condensation through a flexible pipe into an outlet opening in said first container; wherein said flexible pipe passing through said conduit; and wherein said flexible pipe having a snap connector, such that said flexible pipe can become coupled and decoupled within said conduit.

18. The room air conditioning unit of claim 13, wherein slidable association between distal ends of said upright rails of said first frame and said distal ends of said parallel upright rails of said second frame may be locked in place using a press screw or a drop pin.

19. The room air conditioning unit of claim 18, wherein said distal ends of said parallel rods of said first or second frame may be further comprising a horizontal bolt, said horizontal bolt corresponding to a nut on an opposing either said first or said second frame; wherein rotating said horizontal bolt adjusts the width of said gap.

20. The room air conditioning unit of claim 13, wherein a wall of said first container further comprising at least one stability arm, a proximal point of said stability arm pivotally connected to one of said walls of said first container that is adjacent and parallel to a support surface; and wherein when said air conditioning unit is placed over said supporting surface, said at least one arm pivoting toward said supporting surface, such that a distal end of said at least one arm securely jamming against said supporting surface.

* * * * *